US005480238A

United States Patent [19]

Nakano et al.

[11] Patent Number: 5,480,238

[45] Date of Patent: Jan. 2, 1996

[54] THERMAL TRANSFER PRINTER

[75] Inventors: Tetsuo Nakano, Yokohama; Yuichi Takano, Katsuta; Masami Takada, Ibaraki, all of Japan

[73] Assignee: Hitachi, Ltd., Japan

[21] Appl. No.: 279,043

[22] Filed: Jul. 22, 1994

[30] Foreign Application Priority Data

Aug. 3, 1993 [JP] Japan ..... 5-192120
Sep. 3, 1993 [JP] Japan ..... 5-219663

[51] Int. Cl.[6] ..... B41J 11/46

[52] U.S. Cl. ..... 400/120.04; 400/708; 400/249; 400/625

[58] Field of Search ..... 400/120 MP, 120.02, 400/120.04, 625, 602, 708, 240, 240.3, 249; 101/409

[56] References Cited

FOREIGN PATENT DOCUMENTS 227774 10/1987 Japan ..... 400/120 MP
1-317779 12/1989 Japan ..... 400/625
1-301275 12/1989 Japan ..... 400/625

*Primary Examiner*—Edgar S. Burr
*Assistant Examiner*—Steven S. Kelley
*Attorney, Agent, or Firm*—Bardehle & Partners

[57] ABSTRACT

The invention aims at selecting a recording sheet discharge mode in accordance with user's priority of printing speed or printed image quality. In the thermal transfer printer, when discharge concurrent with printing is selected, a microcomputer operates to rotate a mode motor to close a transport passage between a guide member and a platen roller by means of a sheet discharge plate. Starting printing by rotating the platen roller in this state, the leading end of a recording sheet is delivered to a discharge opening, which is defined by the guide member and a guide plate, and introduced between sheet discharge rollers and idler rollers. When separate discharge after printing is selected, the microcomputer starts printing without rotating the mode motor. The sheet discharge plate closes the discharge opening defined by the guide member and the guide plate. The leading end of the recording sheet is delivered to the transport passage between the guide member and the platen roller.

20 Claims, 12 Drawing Sheets

FIG. 9

PRINT MODE 3

FIG. 10

PRINT MODE NORM
V. GAMMA
PRINT COUNT 1
ONE TOUCH PRINT OFF
MEMORY FRAME1 N
MULTI MODE OFF
PICTURE STD
INPUT VIDEO

THERMAL TRANSFER PRINTER

BACKGROUND OF THE INVENTION

The present invention relates to a thermal transfer printer for multi-color printing.

In a color printer, ink of more than one color is used and prints (printed images) made by use of ink of the respective colors are superimposed over one another to depict a multi-colored picture. Recording sheet discharge operation in such a color printer will be described with reference to FIG. 20. FIG. 20 is a diagram for explaining the recording sheet discharge operation in a conventional thermal transfer printer, and it, schematically shows the printer as viewed from front.

A cylindrical platen roller 900 is rotatably supported between frames (not shown) and adapted to be driven at its end for rotation. A guide member 902 and a recording sheet guide 903 are provided along the outer periphery of the platen roller 900 to make a recording sheet 901 wind around the platen roller 900. The guide member 902 and the recording sheet guide 903 serve also as guides for the recording sheet 901 during its feeding. The guide member 902 and the recording sheet guide 903 include auxiliary rollers 905 which are rotatably provided and pressed against the outer periphery of the platen roller 900 by guide members (not shown) to thereby apply a transport force to the recording sheet.

The guide member 902 has a sheet discharge plate 915 for changing the transport passage of the recording sheet 901 in a sheet discharge direction to and from another transport passage along the platen roller 900. The sheet discharge plate 915 is so formed as to swing around a pin 915*a* with the aid of a drive-transmission source (not shown). Feed rollers 906 for feed-transporting the printing sheet 901 are provided just before an insertion opening which is defined by the guide member 902 and the recording sheet guide 903, and idler rollers 907 are provided rotatably to be pressed against the respective feed rollers 906 with a load p. Discharge rollers 908 for discharging the recording sheet are provided just after a discharge opening defined by the guide member 902 and a guide plate 904, and they are associated with idler rollers 907' in substantially the same manner as the feed rollers 906. A thermal head 909 is fixed on a head arm 911 which can be swung vertically around a pin 910, so that it can be pressed against the platen roller 900 with a predetermined load.

An ink ribbon 912 includes a base film on which ink of three colors of yellow, magenta and cyanine is coated in sequence, though the three colors are not shown. The ink ribbon 912 is wound around a supply reel 913 and a take-up reel 914, and the reels are respectively fitted on a supply reel base and a take-up reel base (both not shown) which generate a predetermined rotational torque.

The operation will be now described. The platen roller 900, the feed rollers 906 and the idler rollers 907 are driven by a motive power source (not shown), and the recording sheet 901 is transported to a guide unit that is constituted by the guide member 902 and the recording sheet guide 903. Further, the recording sheet 901, under the guidance of the recording sheet guide 903, passes between the platen roller 900 and the auxiliary rollers 905, winds around the platen roller 900 and stops at a position just before it is pressed by the thermal head 909. At this time, the thermal head 909 is separated from the platen roller 900, and the ink ribbon 912 is also stopped.

Subsequently, the ink ribbon 912 is moved with the aid of a sensor (not shown) until its starting end lies in place to prepare the first color of yellow. Then, the thermal head 909 is pressed on the platen roller 900 through the ink ribbon 912 and the recording sheet 901 by means of the head arm 911, and the platen roller 900 is rotated, thereby printing the first color. At this time, since the sheet discharge plate 915 has been moved around the pin 915*a* in the direction indicated by an arrow in FIG. 20 by means of the driving source (not shown), the sheet discharge opening defined by the guide member 902 and the guide plate 904 is closed so that the leading end of the recording sheet 901 is introduced into the transport passage between the guide member 902 and the platen roller 900. After the printing has completed, the thermal head 909 is moved upwardly, and the platen roller 900 is rotated. With the transport force exerted from the platen roller 900 and the auxiliary rollers 905, the recording sheet 901 is transported again to the position just before it is pressed by the thermal head 909.

Thereafter, the second and third colors are likewise printed. When the printing is completed, the thermal head 909 is moved upwardly, and the platen roller 900 is rotated so that the recording sheet 901 is transported to the position just before it is pressed by the thermal head 909. Then, the thermal head 909 is pressed on the platen roller 900 through the ink ribbon 912 and the recording sheet 901, and the sheet discharge plate 915 is swung around the pin 915*a* by the driving source (not shown), thereby closing the transport passage between the guide member 902 and the platen roller 900. When the platen roller 900 is rotated in this state, the leading end of the recording sheet 901 is guided into the discharge opening defined by the guide member 902 and the-guide plate 904, and it is introduced between the sheet discharge rollers 908 and the idler rollers 907'. Upon the leading end of the recording sheet 901 being nipped between the sheet discharge rollers 908 and the idler rollers 907', the thermal head 909 is moved upwardly, and the recording sheet 901 is completely discharged by the transport force from the sheet discharge rollers 908 and the idler rollers 907'. Thus, the operation is completed.

Apparatus having relation to that described above are disclosed, for instance in Japanese Patent Unexamined Publications Nos. 1-317779 and 1-301275.

In the above-described conventional art, the sheet discharge plate 915 is swung and the recording sheet 901 is discharged after printing of the three colors of yellow, magenta and cyanine. Accordingly, there arises a problem that printing time per sheet is so long that the printing speed is low.

If the sheet discharge plate 915 is swung and the recording sheet 901 is introduced into the sheet discharge opening at the same time as printing of the third color, printing time per sheet is shortened, and the printing speed is increased. In this case, in the middle of printing, the leading end of the recording sheet 901 is held between the sheet discharge rollers 908 and the idler rollers 907' and is exerted with another transport force. Therefore, unless the peripheral speed of the platen roller 900 completely accords with that of the sheet discharge rollers 908, there arises a problem that transport of the recording sheet 901 is disturbed to cause irregularity in the quality of a printed image.

Consequently, either of the above-described systems for discharging the recording sheet 901 involves a problem.

SUMMARY OF THE INVENTION

It is therefore an object of the present invention to provide a thermal transfer printer in which a mode of discharging a recording sheet can be selected at user's discretion in accordance with his priority of the printing speed or the printed image quality.

In order to achieve the above object, a thermal transfer printer has control means and is so formed that an operator can select, in accordance with the condition of use, whether a sheet discharge plate is to be swung to discharge a recording sheet after finishing printing of three colors of yellow, magenta and cyanine, or the sheet discharge plate is to be swung to introduce the recording sheet to and discharge it through a sheet discharge opening at the same time as printing of the third color.

The recording sheet is transported by feeder rollers, wound around a platen roller and stopped at a position just before a thermal head is pressed against the platen roller. At this time, the thermal head is separated from the platen roller, and an ink ribbon is stopped. Then, a starting end of the first color of the ink ribbon is detected and moved in place, and the thermal head is pressed against the platen roller through the ink ribbon and the recording sheet. The platen roller is rotated, and printing of the first and second colors is conducted. In order to print the third color, the thermal head is pressed. At this time, it is selected with the aid of change means whether a transport passage of the recording sheet is connected to the side of sheet discharge rollers by swinging the sheet discharge plate, or the transport passage of the recording sheet is connected to the side of the platen roller without swinging the sheet discharge plate.

At the time of printing of the third color, the sheet discharge plate is swung and the recording sheet is introduced into the sheet discharge opening. Then, the leading end of the recording sheet is nipped between the discharge rollers and idler rollers during printing, and an additional transport force is exerted thereon. Therefore, unless the peripheral speed of the platen roller and that of the sheet discharge rollers completely accord with each other, there is a likelihood that transport of the recording sheet is disturbed, and irregularity in the printed image quality occurs, but printing time per sheet can be shortened.

In the case where the sheet discharge plate is swung to discharge the recording sheet after printing of the three colors of yellow, magenta and cyanine, the recording sheet is passed through the same transport passage during printing of all the three colors. Consequently, although printing time per sheet at the time of recording is prolonged, the quality of the printed image is not degraded.

BRIEF DESCRIPTION OF THE DRAWINGS

FIG. 9 is a view for explaining a still other screen display of the thermal transfer printer according to the embodiment of FIG. 6;

FIG. 10 is a view for explaining a still other screen display of the thermal transfer printer according to the embodiment of FIG. 6;

DESCRIPTION OF THE PREFERRED EMBODIMENTS

Figure 1:
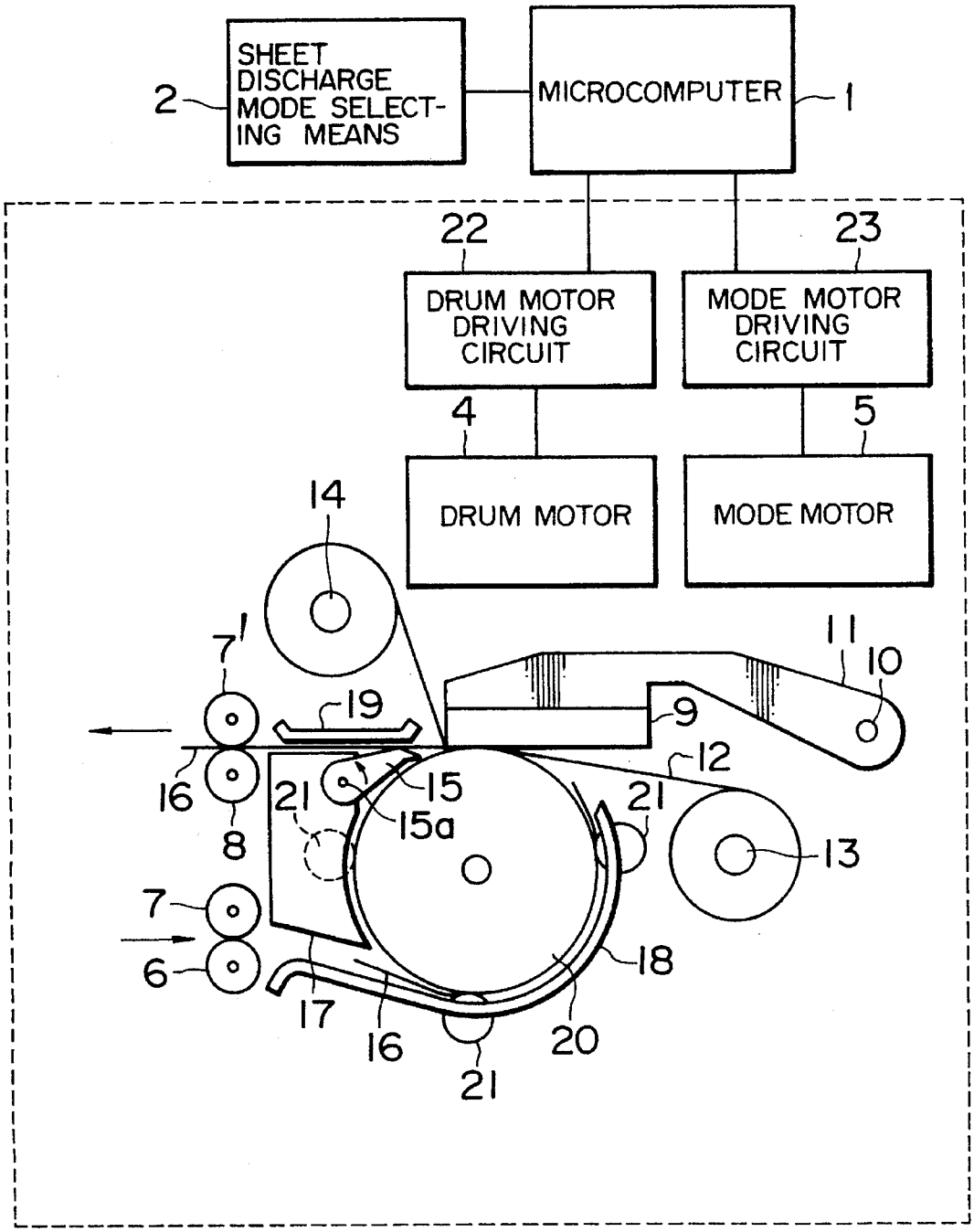
FIG. 1 is a diagram schematically showing the structure of a thermal transfer printer as a first embodiment of the invention.
Figure 2:
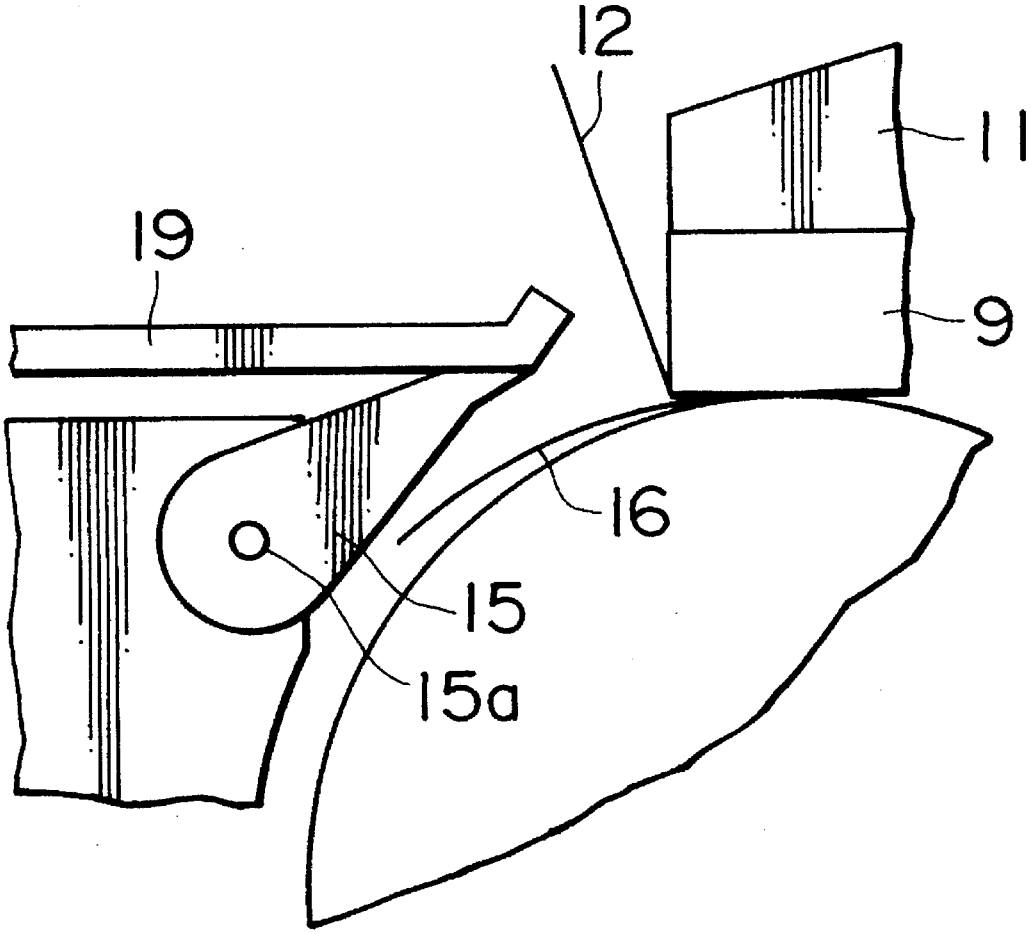
FIG. 2 is an enlarged view showing an essential portion of FIG. 1.

The embodiments of the present invention will be hereinafter described with reference to the attached drawings. FIG. 1 is a diagram showing the first embodiment of the invention, and FIG. 2 is an enlarged view showing an essential portion of FIG. 1.

A cylindrical platen roller 20 is rotatably supported between chassis (not shown) and so formed as to be driven for rotation at its end. A guide member 17 and a recording sheet guide 18 for making a recording sheet 16 wind around the platen roller 20 and for guiding its transportation, are provided in the vicinity of the outer periphery of the platen roller 20. The guide member 17 and the recording sheet guide 18 serve also as guides for the recording sheet 16 during feeding thereof. The guide member 17 and the recording sheet guide 18 include auxiliary rollers 21 which are rotatably provided to be pressed against the outer periphery of the platen roller 20 by guide members (not shown) to thereby apply a transport force to the recording sheet.

The guide member 17 has a sheet discharge plate 15 mounted thereon for changing a transport passage of the recording sheet 16 in a sheet discharge direction to and from another transport passage along the platen roller 20. The sheet discharge plate 15 is formed to swing around a pin 15*a* with the aid of a drive-transmission source (not shown). Feed rollers 6 for feed-transporting the printing sheet 16 are provided just before an insertion opening that is defined by the guide member 17 and the recording sheet guide 18, and idler rollers 7 rotatably press the feed rollers 6 with a load p. Sheet discharge rollers 8 for discharge-transporting the recording sheet are provided just after a discharge opening that is defined by the guide member 17 and a guide plate 19, and they are associated with idler rollers 7' in substantially the same manner as the sheet feed rollers 6. A thermal head 9 is fixed on a head arm 11 which can be swung vertically around a pin 10, so that the head can be pressed against the platen roller 20 with a predetermined load.

An ink ribbon 12 has a base film on which ink of three colors of yellow, magenta and cyanine is applied in sequence, though the three colors are not shown in the figures. The ink ribbon 12 is wound around a supply reel 13 and a take-up reel 14, and the reels are respectively fitted on a supply reel base and a take-up reel base (not shown) which generate a predetermined rotational torque.

The platen roller 20, the feed rollers 6, the discharge rollers 8, the supply reel base and the take-up reel base are connected to a drum motor 4 through a motive power transmission means (not shown) to be rotated through rotation of the drum motor 4. Also, through motive power transmission means (not shown), a mode motor 5 swings the sheet discharge plate 15, which is mounted on the guide member 17, around the pin 15*a*, so as to change the transport passage of the recording sheet 16 in the sheet discharge direction to and from the transport passage along the platen roller 20. Further, through motive power transmission means (not shown), the mode motor 5 vertically swings the head arm 11, on which the thermal head 9 is fixed, around the pin 10, thereby pressing the thermal head against the platen roller 20 with a predetermined load. Rotational operations of the drum motor 4 and the mode motor 5 are controlled by a microcomputer (hereinafter referred to simply as MC) 1 via a drum motor driving circuit 22 and a mode motor driving circuit 23, respectively. Moreover, a sheet discharge mode selecting means 2 is connected to the MC 1.

The operation will now be described. When printing is started, the MC 1 controls the drum motor driving circuit 22 to rotate the drum motor 4, thereby driving the platen roller 20, the feed rollers 6 and the idler rollers 7. The recording sheet 16 is transported to a guide unit that is constituted by the guide member 17 and the recording sheet guide 18. Further, the drum motor 4 is driven in such a manner that the recording sheet 16 is transported along the recording sheet guide 18, passed between the platen roller 20 and the auxiliary rollers 21, wound around the platen roller 20, and stopped at a position just before it is pressed by the thermal head 9. At this time, the thermal head 9 is separated upwardly from the platen roller 20, and the ink ribbon 12 is also stopped.

Subsequently, a starting end of the ink ribbon 12 is detected by a sensor (not shown) and moved in place in preparation of the first color of yellow. Then, the mode motor 5 is rotated through the mode motor driving circuit 23, and the head arm 11 is swung through the motive power transmission means (not shown) so as to press the thermal head 9 on the platen roller 20 through the ink ribbon 12 and the recording sheet 16. When the thermal head 9 is pressed against the platen roller 20, the mode motor 5 is stopped from rotating. At this time, since the sheet discharge plate 15 has been swung around the pin 15*a* in the direction indicated by an arrow in FIG. 1 by means of the driving source (not shown), the sheet discharge opening defined by the guide member 17 and the guide plate 19 is closed.

Then, the platen roller 20 is rotated by the drum motor 4, and the first color is printed. At this time, because the sheet discharge opening defined by the guide member 17 and the guide plate 19 is closed, the leading end of the recording sheet 16 is introduced into the transport passage between the guide member 17 and the platen roller 20. After the printing, the thermal head 9 is moved upwardly, and the platen roller 20 is rotated. With the transport force from the platen roller 20 and the auxiliary rollers 21, the recording sheet 16 is transported again to the position just before it is pressed by the thermal head 9. Thereafter, the second color is likewise printed.

When printing of the second color is completed, the thermal head 9 is moved upwardly, and the platen roller 20 is rotated so that the recording sheet 16 is transported again to the position just before it is pressed by the thermal head 9. Then, the mode motor 5 is rotated through the mode motor driving circuit 23, and the head arm 11 is swung through the motive power transmission means (not shown) to press the thermal head 9 on the platen roller 20 through the ink ribbon 12 and the recording sheet 16. At this time, the MC 1 detects a condition of the sheet discharge mode selecting means 2. The sheet discharge mode selecting means 2 selects either discharge at the same time as printing or independent discharge after printing.

If discharge at the same time as printing is selected, the mode motor 5 is rotated through the mode motor driving circuit 23, and the sheet discharge plate 15 is swung around the pin 15*a* through the motive power transmission means (not shown), thereby closing the transport passage between the guide member 17 and the platen roller 20. This condition is shown in FIG. 1. When printing is started by rotating the platen roller 20 in this state, the leading end of the recording sheet 16 is transported to the discharge opening defined by the guide member 17 and the guide plate 19, and it is introduced between the sheet discharge rollers 8 and the idler rollers 7'. According as the printing is continued in this condition, the leading end of the recording sheet 16 is nipped between the sheet discharge rollers 8 and the driven rollers 7'. After printing is finished, the thermal head 9 is moved upwardly, and the recording sheet 16 is completely discharged by the transport force from the sheet discharge rollers 8 and the idler rollers 7'. Thus, the printing operation is completed.

In the case that independent discharge after printing is selected, printing is started without rotating the mode motor 5. At this time, since the sheet discharge plate 15 is in the condition shown in FIG. 2, the discharge opening defined by the guide member 17 and the guide plate 19 is closed. The leading end of the recording sheet 16 is introduced into the transport passage between the guide member 17 and the platen roller 20. After printing is finished, the thermal head 9 is moved upwardly, and the platen roller 20 is rotated. Owing to the transport force from by the platen roller 20 and the auxiliary rollers 21, the recording sheet 16 is delivered to the position just before it is pressed by the thermal head 9.

The mode motor 5 is rotated through the mode motor driving circuit 23. By means of the motive power transmission means (not shown), the thermal head 9 is pressed on the platen roller 20 through the ink ribbon 12 and the recording sheet 16, and the sheet discharge plate 15 is swung around the pin 15*a* to close the transport passage between the guide member 17 and the platen roller 20. This condition is shown in FIG. 1. When the platen roller 20 is rotated in this state, the leading end of the recording sheet 16 is transported to the discharge opening defined by the guide member 17 and the guide plate 19, and it is introduced between the sheet discharge rollers 8 and the idler rollers 7'. When the leading end of the recording sheet 16 is nipped between the sheet discharge rollers 8 and the idler rollers 7', the thermal head 9 is moved upwardly, and the recording sheet 16 is completely discharged with the transport force exerted by the sheet discharge rollers 8 and the idler rollers 7'. Thus, the operation is completed.

With these operations, an operator can select either printing in which the printing time has priority or printing in which the quality of printed image has priority, so that the selected printing operation can be effected.

Figure 3:
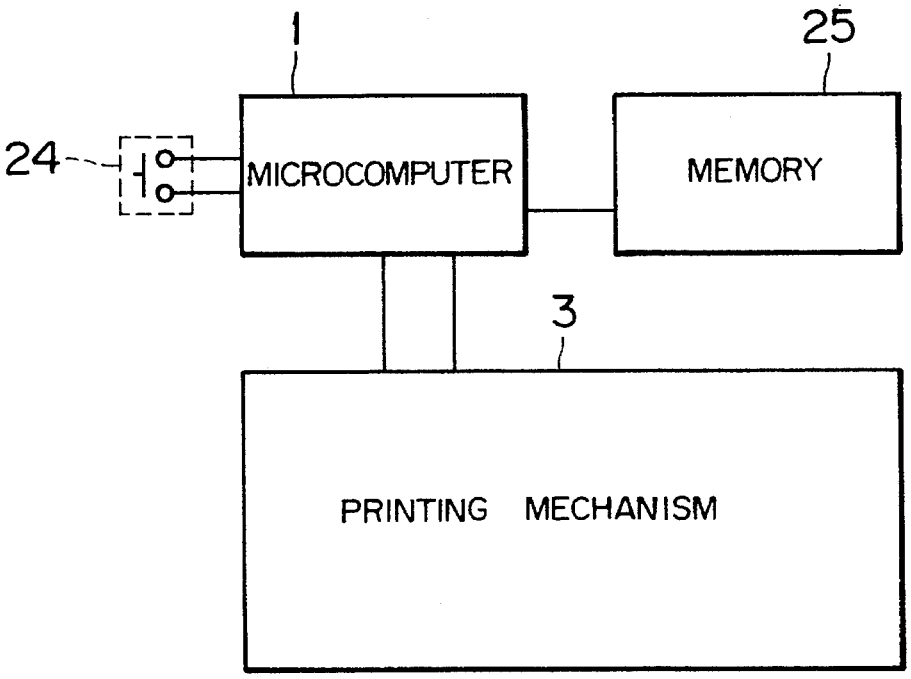
FIG. 3 is a block diagram showing a specific example of the sheet discharge mode selection means of FIG. 1.

FIG. 3 is a block diagram showing a specific example of the sheet discharge mode setting means of FIG. 1. In this example, a memory 25 constitutes the sheet discharge mode setting means 2.

A discharge mode of the recording sheet 16 is selected through a switch 24 which is connected to the MC 1. The selected result is stored in the memory 25 which is connected to the MC 1. The contents to be set in the memory 25 are either discharge at the same time as printing of the last color or discharge after printing of the last color. As the operation switch 24 to this end, a switch for exclusive use of setting the sheet discharge mode may be provided, or switches for other operations may be used to also set the discharge mode through a predetermined operation procedure. Thus, the sheet discharge mode setting means can be constituted of the memory 25. The operation is not different from that of the sheet discharge mode setting means shown in FIG. 1, and printing is performed by controlling the printing mechanism 3.

Figure 4:
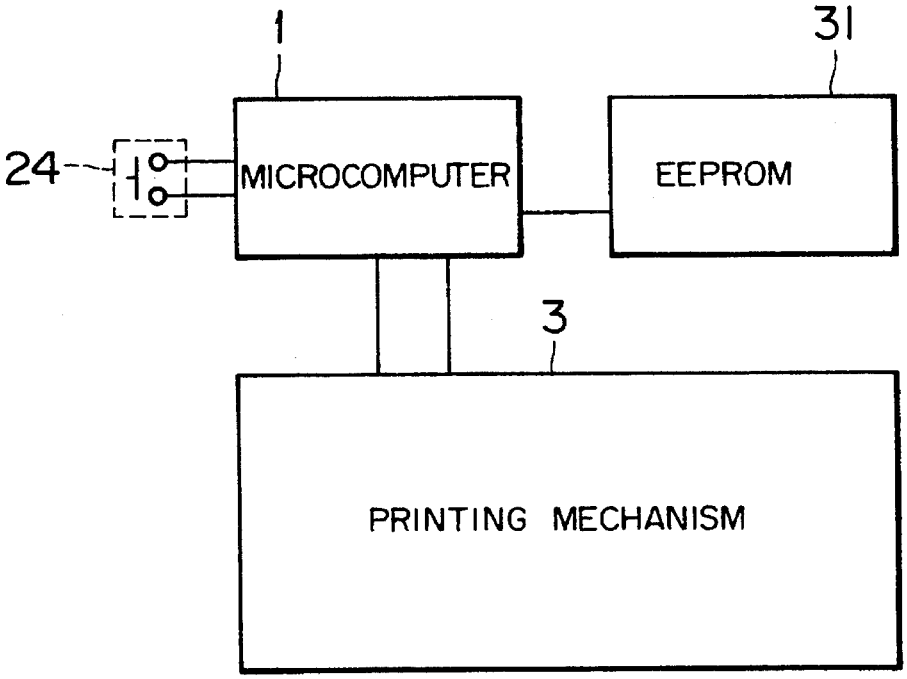
FIG. 4 is a block diagram showing another specific example of the sheet discharge mode selection means of FIG. 1.

FIG. 4 is a block diagram showing another specific example of the sheet discharge mode setting means of FIG. 1. In this example, a non-volatile memory (hereinafter referred to as EEPROM) 31 in which erasing and writing can be performed electrically constitutes the sheet discharge mode setting means 2.

Selection of a discharge mode of the recording sheet 16 is made through the switch 24 which is connected to the MC 1. The selected result is stored in the EEPROM 31 which is also connected to the MC 1. The contents to be set in the EEPROM 31 are either discharge at the same time as printing of the last color or discharge after printing of the last color. As the operation switch 24 to this end, a switch for exclusive use of setting the sheet discharge mode may be provided, or switches for other operations may be used to also set the discharge mode through a predetermined operation procedure. Thus, the sheet discharge mode setting means can be constituted of the EEPROM 31. Moreover, setting of the sheet discharge mode is recorded in the EEPROM 31 so that even if power supplied to the printer via a power source circuit (not shown) is shut off, the setting is still recorded and there is no need to reset the sheet discharge mode. The operation is not different from that of the sheet discharge mode setting means shown in FIG. 1, and printing is performed by controlling the printing mechanism 3.

Figure 5:
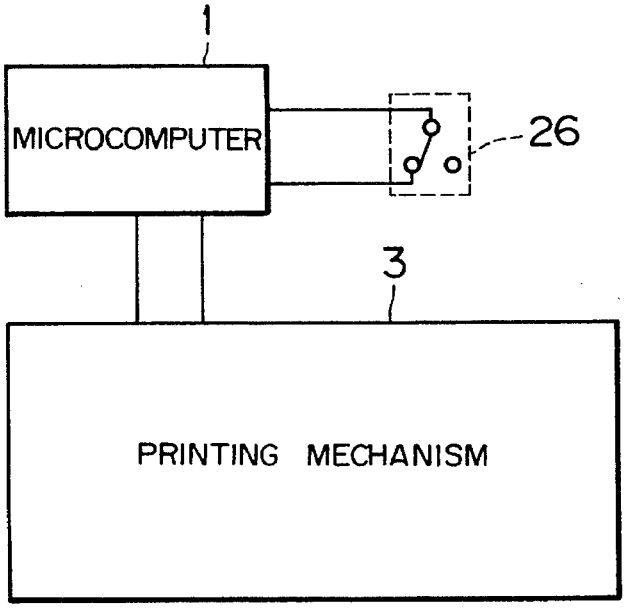
FIG. 5 is a block diagram showing still another specific example of the sheet discharge mode selection means of FIG. 1.

FIG. 5 is a block diagram showing another specific example of the sheet discharge mode setting means of FIG. 1. In this example, a mechanically selective switch 26 constitutes the sheet discharge mode setting means 2.

A discharge mode of the recording sheet 16 is selected through the mechanical switch 26 which is connected to the MC 1. In FIG. 5, the mechanical switch 26 is a switch which can mechanically maintain the set condition, such as a slide switch, a toggle switch and a push switch. In such a mechanical switch, the operation condition is selected depending on whether its contact is opened or closed. The operation is not different from that of the sheet discharge mode setting means shown in FIG. 1, and printing is performed by controlling the printing mechanism 3.

Figure 6:
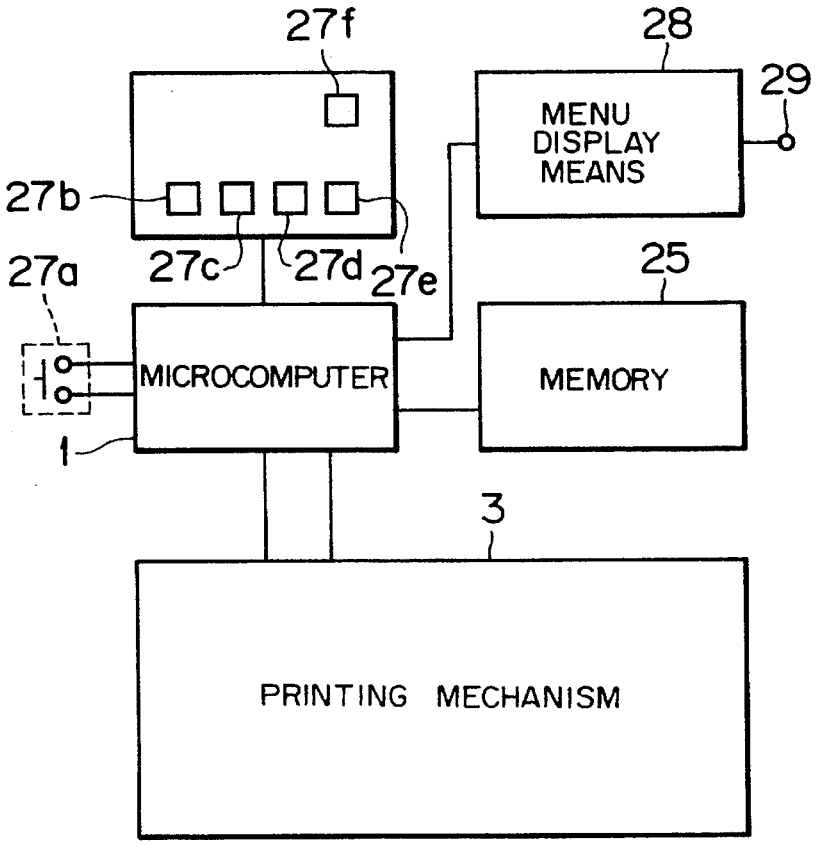
FIG. 6 is a block diagram schematically showing the structure of a thermal transfer printer as a second embodiment of the invention.

FIG. 6 is a block diagram showing the second embodiment of the invention. In this embodiment, the memory 25, menu display means 28 and switches 27*a*–27*f* are connected to the MC 1, and the memory 25 constitutes sheet discharge mode setting means 2 as described above. Further, a signal output terminal 29 for outputting signals to the outside is provided to be connected to the menu display means 28.

The switch 27*a* is a switch for letting the MC 1 control a power source circuit (not shown) so as to turn on and off power supply to the color printer. The switch 27*b* serves to turn on and off the display of menus of a hierarchical structure for setting an operation condition of the color printer, and the switch 27*c* serves to change the display of a menu in the hierarchical structure to the display of another menu one stage below. The switches 27*d*, 27*e* serve to select each setting item or to determine values while a menu is displayed on the screen, and the switch 27*f* serves to turn on and of the display of an operation condition of the color printer shown in FIG. 10.

Figure 7:
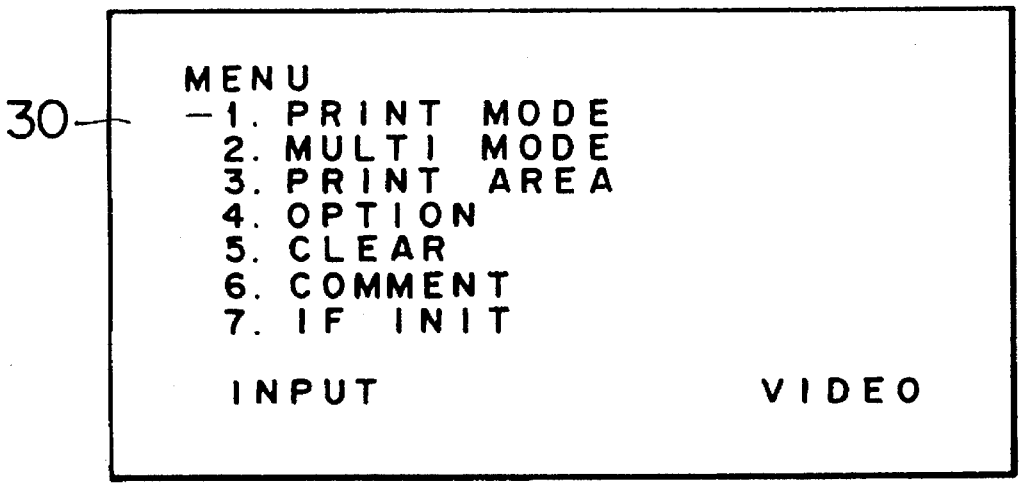
FIG. 7 is a view for explaining a screen display of the thermal transfer printer according to the embodiment of FIG. 6.
Figure 8:
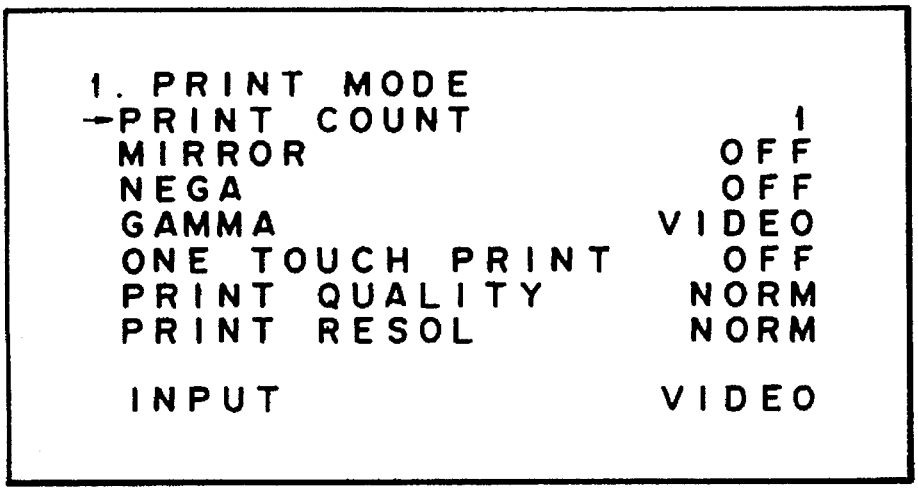
FIG. 8 is a view for explaining another screen display of the thermal transfer printer according to the embodiment of FIG. 6.

One example of operation will now be described. The power supply to the color printer is turned on by means of the switch 27*a* to start the operation. In order to set an operation condition, the switch 27*b* is turned on, and the MC 1 controls the menu display means 28 so that a menu of FIG. 7 is displayed. In the menu, items of menus in the subordinate files and a cursor 30 are indicated. The cursor 30 is moved to an item one line below by turning on the switch 27*c* to select one of the menus in the subordinate files. When the switch 27*c* is turned on while the menu of FIG. 7 is displayed, the menu in the subordinate file selected by the cursor 30 is displayed. One example of the menu in the subordinate file is shown in FIG. 8. When the switch 27*c* is turned on while the menu of FIG. 8 is displayed, the cursor 30 moves to an item one line below, and this item is selected. At this time, by turning on the switches 27*d*, 27*e*, setting of the item selected by the cursor 30 is performed.

AS one example of a menu in a subordinate file, FIG. 9 shows a menu for displaying the sheet discharge mode setting means. A single menu may be employed as shown in FIG. 9. Alternatively, two or more items may be provided is such a manner as shown in FIG. 8, and selection and setting of one item may be conducted by the cursor 30. The result selected by use of the menu is stored in the memory 25 which is connected to the MC 1.

Thus, the sheet discharge mode setting means 2 can be constituted of a combination of the memory 25, the menu display means 28 and the switches. The operation is not different from that of the sheet discharge mode setting means shown in FIG. 1, and printing is performed by controlling the printing mechanism 3.

Another example of operation will be described. In the above-described operation method, setting can be performed by an ordinary menu operation. However, when it is desirable that operation of the sheet discharge mode setting means is limited to a person in charge of control of the printer, the system may be so formed that, the menu for setting the sheet discharge mode is displayed only when keys are pressed in particular combination. This operation method will now be described with reference to FIG. 6. In an ordinary operation condition, setting is performed by operating the switches 27*b*, 27*c*, 27*d*, 27*e* in such a manner as described above. During this operation, however, the sheet discharge mode setting menu is not displayed. In order to display the sheet discharge mode setting menu, for example, there is a method of pressing the three switches 27*a*, 27*b* and 27*f* at the same time. These switches will not be turned on simultaneously in the normal operation condition. If only the person in charge knows this operation method, the sheet discharge mode will not be set by ordinary users. Although the three switches 27*a*, 27*b* and 27*f* are combined herein, other combinations may be likewise employed. Also, the number of the switches to be operated simultaneously may be as well two or more. The operation is not different from that of the sheet discharge mode setting means shown in FIG. 1.

Next, the third embodiment of the invention will be described with reference to the attached drawings.

Figure 11:
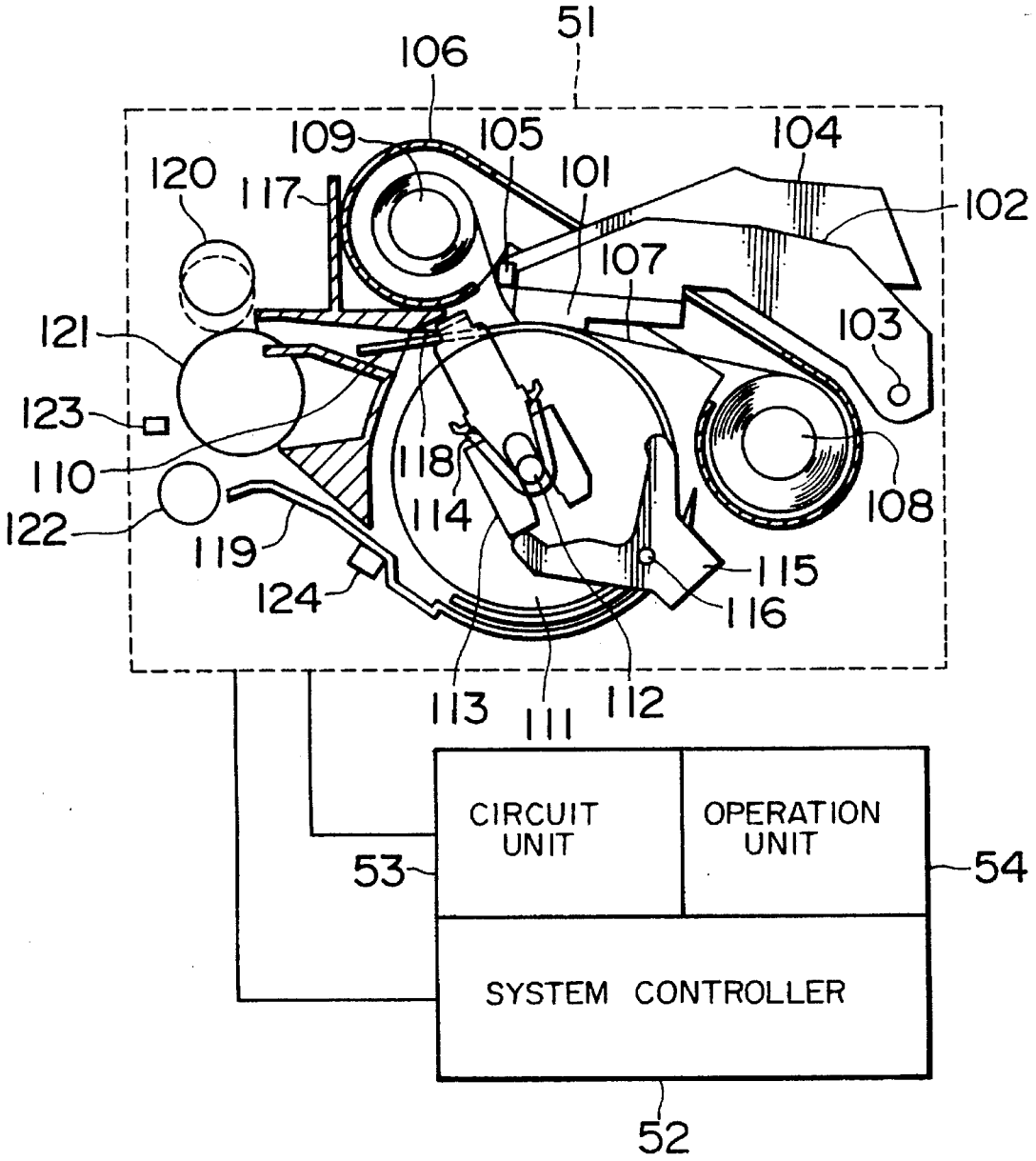
FIG. 11 is a diagram schematically showing the structure of a thermal transfer printer as a third embodiment of the invention.
Figure 12:
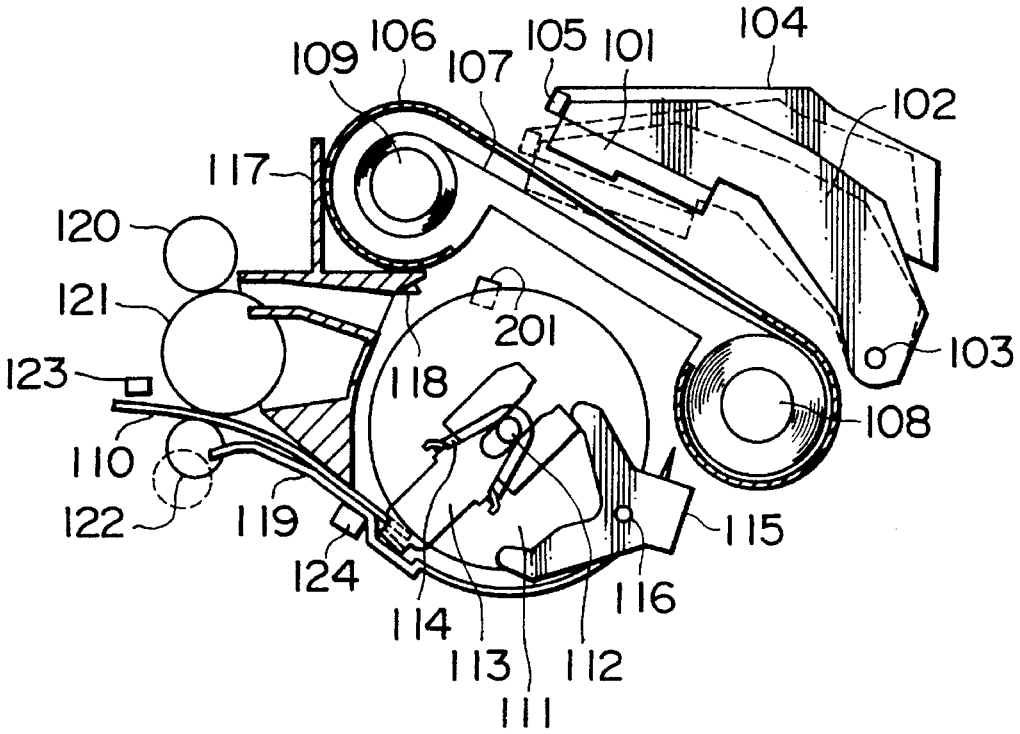
FIG. 12 is a diagram showing the structure of a mechanism unit of FIG. 11 in the state of a sheet feeding operation.
Figure 13:
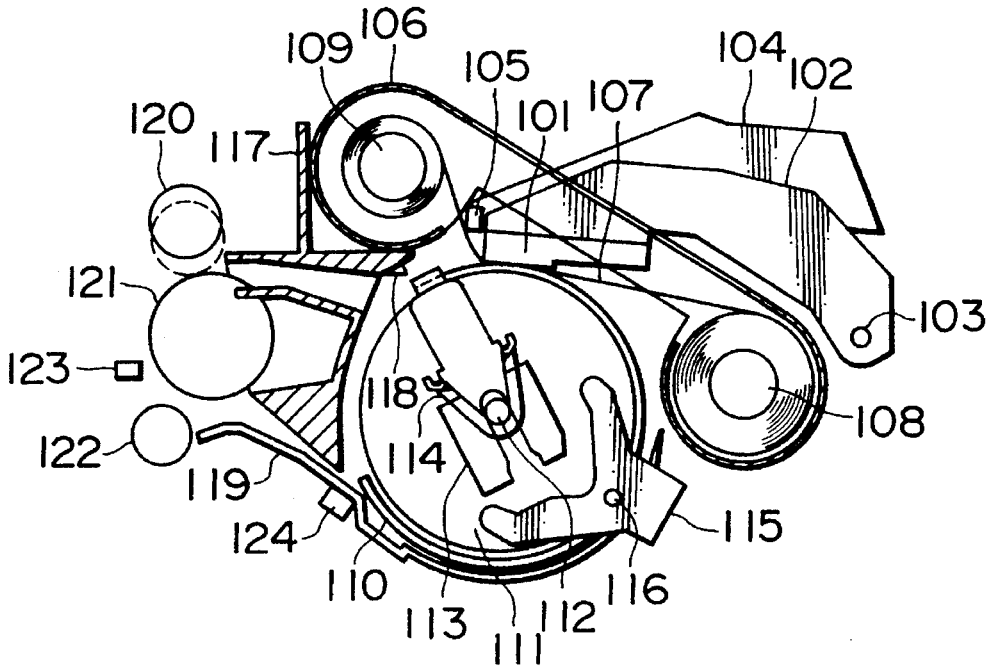
FIG. 13 is a diagram showing the structure of the mechanism unit of FIG. 11 in the state of a recording operation.

FIG. 11 is a diagram schematically showing the structure of a thermal transfer printer as the third embodiment of the invention. This figure illustrates an operation condition of a mechanism unit 51 when a recording sheet is discharged. FIG. 12 is a diagram showing the structure of the mechanism unit of FIG. 11 in a condition of sheet feeding operation. FIG. 13 is a diagram showing the structure of the mechanism unit of FIG. 11 in a condition of recording operation.

First, the structure of this embodiment will be described with reference to FIG. 11. In this figure, reference numeral 51 denotes the mechanism unit of the thermal transfer printer, 52 a system controller for controlling the entire apparatus, 53 a circuit unit for driving the mechanism unit and processing images to be recorded, and 54 an operation unit for operating the apparatus from the outside.

The mechanism unit 51 comprises component elements which will be described below. Reference numeral 101 denotes a thermal head, 102 a head arm for supporting the thermal head, 103 a shaft for rotation of the head arm, 104 a radiation fin for radiating heat of the thermal head, and 105 ink sensors mounted on the radiation fin. The thermal head 101, the head arm 102, the radiation fin 104 and the ink sensors 105 are swung all together around the rotation shaft 103 vertically. The ink sensors 105 are light detecting elements such as phototransistors, and they are provided both on this side and the opposite side of the mechanism unit in FIG. 11, respectively.

Reference numeral 106 denotes an ink cassette, 107 an ink sheet or ribbon received in the ink cassette, 108 a supply shaft on which the ink ribbon is wound, and 109 a take-up shaft of the ink ribbon. The ink cassette 106 is inserted into the printer from this side of FIG. 11 to be installed thereon while the thermal head is separated upwardly.

Reference numeral 110 denotes a recording sheet, 111 a drum on which the recording sheet is wound, 112 a shaft for rotation of the drum, 113 a chuck for holding the recording sheet on the drum, 114 a spring attached to the chuck, 115 a driving arm for driving the chuck, and 116 a shaft for rotation of the driving arm. The chuck 113 is rotatable about the rotation shaft 112 and also movable in the radial direction of the drum 111. Usually, the chuck 113 is urged toward the center axis of the drum 111 by the spring 114. By swinging the driving arm 115, the chuck 113 is moved toward the outside of the drum 111.

Reference numeral 117 denotes a guide for the recording sheet, 118 an engaging portion formed on the guide 117,119 a guide for the recording sheet, 120, 121 and 122 rollers, and 123 and 124 sensors for detecting the recording sheet. The engaging portion 118 is a projection on the guide 117. When the chuck 113 is moved upwardly, the chuck 113 collides against the engaging portion 118 so that the chuck 113 stays at the same position even if the drum 111 is rotated. The rollers 120 are urged toward the rollers 121 by forces exerted by springs or the like (not shown). However, when the thermal head 101 is pressed on the drum 111, the rollers 120 are moved upwardly. The rollers 122 are pressed on the rollers 121 only when feeding of the recording sheet, and they feed the recording sheet. The sensors 123, 124 are elements such as photointerrupters and serve to detect the recording sheet. The guide 119 located between the sensor 124 and the drum 111 is formed with a hole at a position corresponding to the sensor 124 so that insertion of the recording sheet 110 between the guide 119 and the drum 111 can be detected.

In FIG. 12, reference numeral 201 denotes light emitting elements such as a light emitting diode. The light emitting elements 201 are provided both on this side and the opposite side of the mechanism unit in FIG. 12, respectively. The same component elements as shown in FIG. 11 are designated by the same reference numerals. Similarly, in FIG. 13, the same component elements as shown in FIG. 11 are designated by the same reference numerals.

The operation of this embodiment will now be described with reference to FIGS. 11, 12 and 13.

Firstly, the feeding operation of the recording sheet will be described with reference to FIG. 12.

The chuck 113 is swung to a recess formed in the guide 119, and it stands by there. When the recording operation is started, the driving arm 115 is swung to press the chuck 113 downwardly. Subsequently, the rollers 122 are pressed up to the rollers 121, and the recording sheet 110 fed by sheet feeding means (not shown) is inserted between the rollers 122 and 121. The rollers 121 are exerted through a torque clutch (not shown) with a force for rotating them in a direction opposite to the insertion of the recording sheet 110. When a single recording sheet 110 is inserted, as the force from the torque clutch is weaker than a friction force between the recording sheet 110 and the rollers 122, the rollers 121 rotate in the insertion direction of the recording sheet 110. When two or more recording sheets 110 are inserted, the rollers 122 are rotated reversely to return unnecessary recording sheets. In this manner, the torque of the torque clutch is set. After the inserted recording sheet 110 is detected by the sensor 124, it is further transported for a predetermined distance, and the recording sheet 110 reaches a gap between the drum 111 and the chuck 113. The driving arm 115 is then swung in a direction away from the chuck 113, and the chuck 113 is moved toward the center axis of the drum 111 by the spring 114, so that an end portion of the recording sheet 110 is pressed against and held on the drum 111 by the chuck 113.

Then, the head arm 102 is lowered to a position indicated by a dotted line in FIG. 12, and the take-up shaft 109 is rotated to wind the ink ribbon 107 thereon. When the ink sensors 105 detect a starting end of the ink for one picture, transport of the ink ribbon 107 is stopped, and positioning of the starting end of the ink ribbon is performed.

Figure 16A:
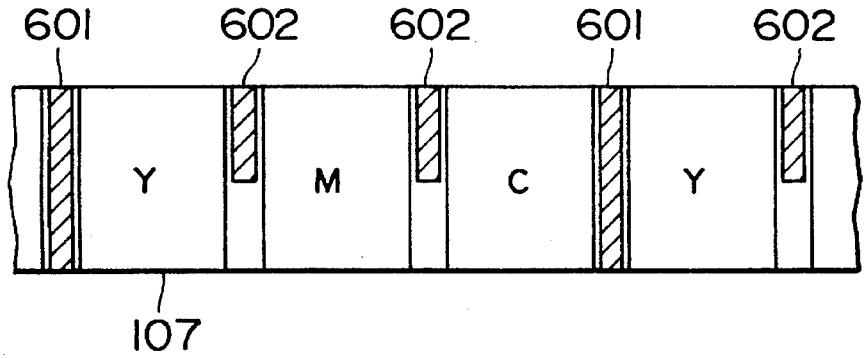
FIGS. 16A and 16B are diagrams for explaining kinds of ink ribbon received in the ink cassette of FIG. 15.

The ink ribbon used in this embodiment is shown in FIG. 16A, which will be described later. The ink ribbon 107 was thereon color ink for color printing of yellow (Y), magenta (M) and cyanine (C) applied in sequence. Further, marks 601 each indicating the boundary of ink for one picture, and marks 602 indicating color ink boundaries, are provided on the ink ribbon 107. Ink portions of the ink ribbon 107 transmit infrared rays whereas mark portions thereof do not transmit infrared rays. Therefore, in the ink portions, infrared rays emitted from the light emitting elements 201 pass through the ink ribbon 107 and reach the ink sensors 105. In the mark portions, however, the rays do not reach the ink sensors 105. Since the ink sensors 105 and the light emitting elements 201 are provided both on this side and on the opposite side of the mechanism unit, the ink boundaries for one picture or image and the boundaries between the colors can be discriminated.

Recording operation will now be described with reference to FIG. 13.

After feeding of the recording sheet 110 and positioning of the starting end of the ink ribbon 107, the drum 111 is rotated until the chuck 113 passes below the thermal head 101. Then, the thermal head 101 is pressed against the drum 111 with the ink ribbon 107 and the recording sheet 110 being interposed therebetween. In this condition, the ink ribbon 107 is taken up by the take-up shaft 109, the drum 111 is rotated, and the thermal head 101 is supplied with power to perform thermal-transfer recording. After the recording of the first color of yellow is completed, the thermal head 101 is temporarily separated upwardly, and positioning of the starting end of the second color ink is performed. After the chuck 113 passes below the thermal head 101 again, the thermal head 101 is pressed against the drum 111, thus performing recording of the second color.

Subsequently, recording operation of the last color will be described with reference to FIG. 11.

When the three colors of yellow, magenta and cyanine are recorded in superposition for color recording, the third color of cyanine is the last color to be printed. In order to record the last color, in substantially the same manner as the first and second colors, the thermal head 101 is temporarily separated upwardly, positioning of the starting end of the third color of the ink ribbon is performed, and after the chuck 113 passes below the thermal head 101, the thermal head 101 is pressed on the drum 111. At the same time, the driving arm 115 is swung to press the chuck 113 upwardly. In this condition, the drum 111 is rotated, thereby performing thermal-transfer recording. The chuck 113 thus pressed upwardly collides against the engaging portion 118 and is held in that position. Accordingly, as the drum 111 rotates, the end portion of the recording sheet 110 passes through the gap between the chuck 113 and the drum 111, and further, it is transported toward the rollers 121 while passing through a path in the guide 117. Since the rollers 120 keep being lifted upwardly while the thermal head 101 is pressed on the drum 111, even when the recording sheet is transported to the rollers, the printed image will not be affected.

After the recording is completed, the thermal head 101 is lifted upwardly. At the same time, the rollers 120 are pressed against the rollers 121 to hold the recording sheet 110. Further, the rollers 121 are rotated, and the recording sheet 110 is discharged out of the printer.

Thermal-transfer recording is performed in the manner described above. The above description has been made on the first discharge operation in which the recording sheet is released from the retention just before recording of the last color, and the recording sheet is discharged while the recording is conducted.

In the case of the above operation, recording of the last color and discharge of the recording sheet are conducted concurrently with each other, and consequently, operation time required for recording each sheet can be shortened. At the time of the last color recording, however, the recording sheet is merely held between the drum and the thermal head, as shown in FIG. 11. If a friction force between the rear surface of the recording sheet and the drum is insufficient, there is a possibility that the recording sheet will slip off with respect to the drum during the recording. In case the recording sheet slips off, a slippage of color occurs, thereby involving deterioration of the picture quality.

When a slippage of color occurs, the operation unit 54 shown in FIG. 11 is operated to change the operation sequence into the second discharge operation in which the recording sheet is discharged after recording of the last color is completed. By this operation change, deterioration of the quality of a recorded picture or image can be prevented.

The second discharge operation will now be described.

When the operation sequence is changed to the second discharge operation by operating the operation unit 54 of FIG. 11, the system controller 52 detects the operation change and commands the mechanism unit 51 to function in the second discharge operation mode. In substantially the same manner as the operation described above with reference to FIGS. 12 and 13, recording of the first and second colors is carried out. In order to record the last color of cyanine, similarly to the case of printing the first and second colors, the thermal head 101 is pressed on the drum 111 after the chuck 113 passes below the thermal head 101, and thermal-transfer recording is performed while the recording sheet 110 is held by the chuck 113. After the recording of the last color is completed, as shown in FIG. 11, the recording sheet 110 is released from the retention by the chuck 113, and while the thermal head 101 is pressed on the drum 111, the recording sheet 110 is transported until its end portion reaches the rollers 121. When the end portion of the recording sheet 110 arrives at the rollers 121, the thermal head 101 is moved upwardly, and the rollers 120 are pressed against the rollers 121. Then, the recording sheet 110 is held between the rollers 120 and 121, and it is transported and discharged out of the printer.

This is the sequence of the second discharge operation.

In the case of the second discharge operation, as the recording sheet is not released from the retention by the chuck until the recording of the last color is completed, deterioration of the image quality due to color slippage can be prevented.

In this embodiment, as described above, even if a recording sheet does not have sufficient friction, the discharge operation can be changed by operating the printer from the outside, and a recorded image of a high quality with no color slippage can be obtained.

The fourth embodiment of the invention will be described with reference to FIGS. 14 to 17.

This embodiment is an example in which kinds of ink ribbon or kinds of recording sheet are automatically discriminated from one another, and the discharge operation is accordingly changed.

Figure 14:
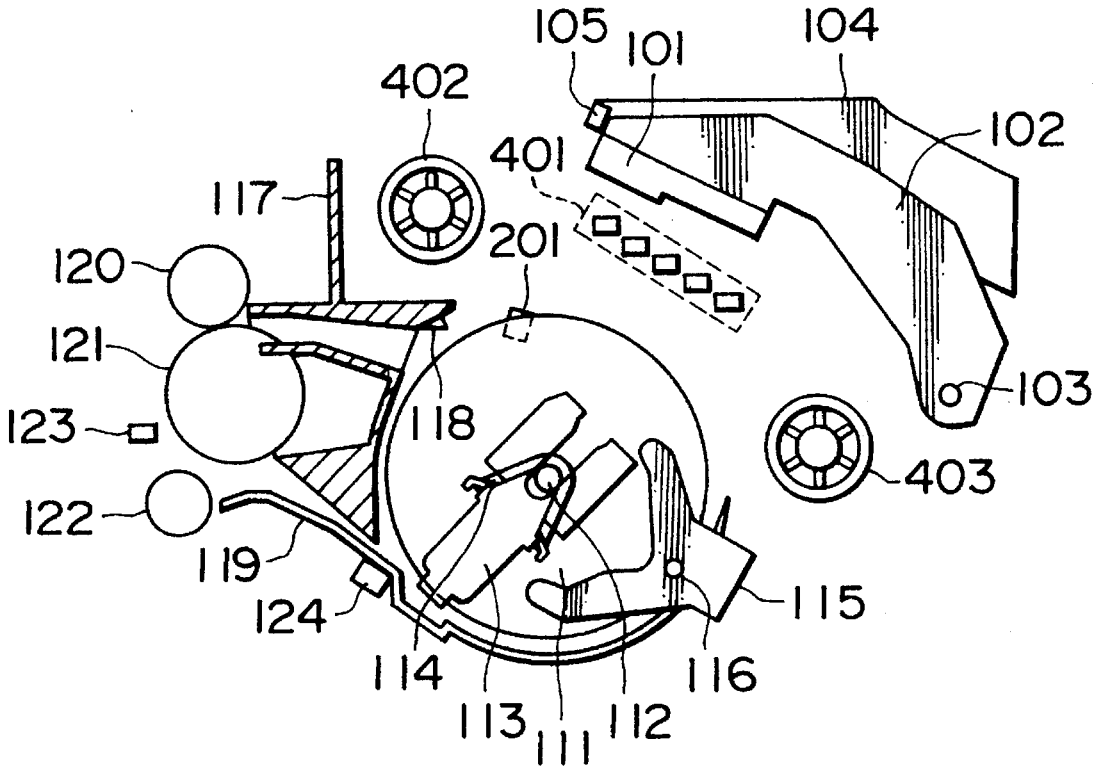
FIG. 14 is a diagram showing the structure of a mechanism unit in a thermal transfer printer as a fourth embodiment of the invention.

FIG. 14 is a diagram showing the structure of a mechanism unit in a thermal transfer printer according to the fourth embodiment of the invention when an ink cassette is not installed thereon. In this figure, reference numeral 401 denotes a sensor for knowing or judging the kind of ink cassette, 402 a reel base on which a take-up shaft of the ink ribbon is fitted, and 403 a reel base on which a supply shaft of the ink ribbon is fitted. The same component elements as shown in FIG. 11 are designated by the same reference numerals. In this embodiment, the cassette judgement sensor 401 comprises five sensor elements, and each of the sensor elements is a light sensor such as a photointerrupter.

Figure 15:
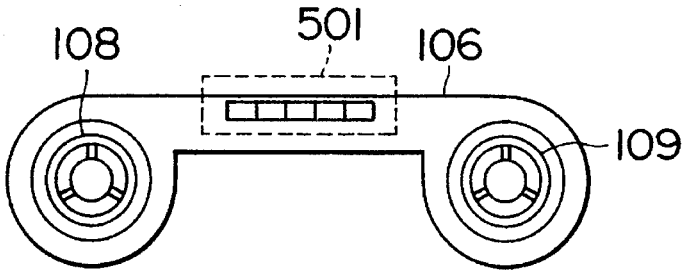
FIG. 15 is a front view showing an ink cassette which is to be installed on the thermal transfer printer of FIG. 14.

FIG. 15 is a front view showing the ink cassette which is to be installed on the thermal transfer printer of FIG. 14. In FIG. 15, reference numeral 501 denotes reflection plates attached to the surface of the ink cassette, 106 the ink cassette, 108 the supply shaft of the ink ribbon, and 109 the take-up shaft of the ink ribbon. The reflection plates 501 are located at such positions that they confront with the cassette judgement sensor 401 when the ink cassette is installed on the mechanism unit of the thermal transfer printer of FIG. 14. The cassette judgement sensor 401 detects existence of the respective reflection plates 501 to discriminate the kind of the installed ink cassette, i.e., the kind of the ink ribbon in the ink cassette. In this embodiment with the five reflection plates and the five sensor elements, 32 kinds of ink can be discriminated, i.e., the fifth power of 2.

Figure 16B:
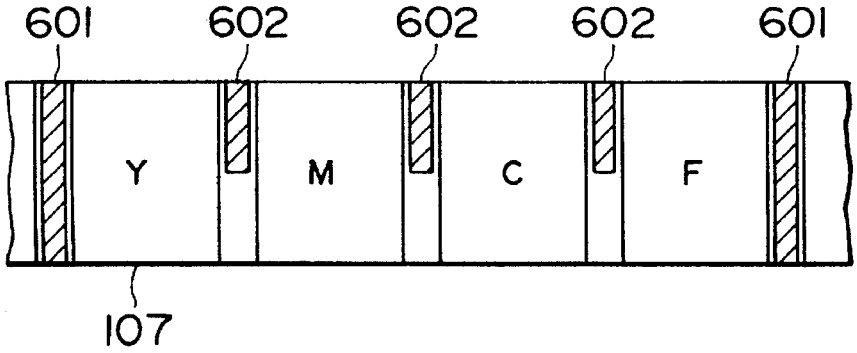

FIGS. 16A and 16B are diagrams for explaining the kinds of ink ribbon received in the ink cassette shown in FIG. 15. FIG. 16A shows an ink ribbon on which ink of three colors of yellow (Y), magenta (M) and cyanine (C) is applied successively in this order. Marks for indicating ink boundaries are provided both on boundaries between the colors and on boundaries between the one-picture ink areas. FIG. 16B shows another ink ribbon on which finisher layers (F) are provided in addition to the three color ink. The finisher layers serve to transfer a transparent protective layer onto each printed image after color recording of the three color ink so as to increase durability of the recorded image or picture.

In the ink ribbon with the finisher layers shown in FIG. 16B, each protective layer is transferred last. The protective layer to be transferred is transparent. Therefore, even if a slippage of the protective layer occurs, it is not visually recognized and does not cause any deterioration of the image quality. If necessary, it may be as well to, only for transfer of each protective layer, use a larger area than that for printing an image. In this case, even if a slippage of the protective layer occurs, the printed area of the image is sufficiently covered with the transferred area of the protective layer.

Accordingly, in the thermal transfer printer shown in FIG. 14, when it is detected that, for example, the ink cassette installed thereon contains the ink ribbon with the finisher layers, the first discharge operation in which discharge is performed while the last color is recorded, is carried out irrespective of the current setting of the discharge mode.

In this embodiment, when the ink ribbon is of a kind with which a slippage of the ribbon during the last transfer does not cause the problem of deterioration of the image quality, such as the ink ribbon with the finisher layers, the first discharge operation is conducted irrespective of the currently setting in the operation unit of the printer. As a result, time for recording each sheet can be shortened.

The above explanation has been given of the ink ribbon with the finisher layers. However, when an ink ribbon applied with black ink alone is used for white recording sheets, for example, the problem of a color slippage or deviation can not be caused, and it is obvious that the operation in this case should be performed similarly to the above explanation. On the other hand, when ordinary paper is used as recording sheets instead of paper for exclusive use, and when an ink ribbon with receptor layers is used for recording of the ordinary paper, frictional force of the recording sheets is probably insufficient because the recording sheets are not exclusive-use paper but ordinary paper. In this case, the second discharge operation in which discharge is conducted after completing the recording, is carried out irrespective of the current setting of the discharge mode.

Moreover, in this embodiment, the discrimination of the kind of ink cassette is performed through the reflection plates provided on the ink cassette. However, the kind of ink cassette may be inputted or indicated by an operator through the operation unit. Alternatively, it may be as well to employ such a method of adhering a bar code for indicating the kind of ink cassette to a surface of the cassette or the supply shaft of an ink ribbon in an annular shape and reading the bar code.

Description will be now made on discrimination of kinds of recording sheets.

Figure 17:
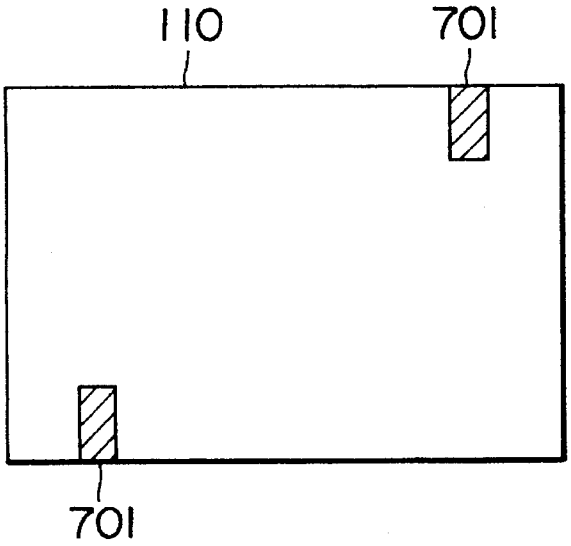
FIG. 17 is a view showing the rear surface of a recording sheet which is fed to the thermal transfer printer of FIG. 14.

FIG. 17 is a view showing the rear surface of a recording sheet which is fed to the thermal transfer printer of FIG. 14. In this figure, reference numeral 110 denotes the recording sheet, and 701 marks provided on the rear surface of the recording sheet. The marks 701 are located at symmetrical positions with respect to the center of the recording sheet 110, respectively, so that either mark can be detected irrespectively of the direction in which the recording sheet is inserted. The sensor 123 shown in FIG. 14 detects the kind of the recording sheet 110 depending on existence of the mark 701 of the sheet rear surface when the recording sheet 110 is fed.

Provided here the existence of the mark 701 means that friction of the rear surface of the recording sheet 110 to be used is high, and no existence of the mark 701 means low friction. When the mark 701 on the rear surface is detected by the sensor 123, since the friction of the recording sheet 110 is high and no slippage of color occurs, the first discharge operation is to be conducted. When the mark 701 does not exist on the rear surface, since the friction of the recording sheet 110 to be used is low and a slippage of color is liable to occur, the second discharge operation is to be conducted.

In the foregoing description, discrimination of the recording sheet is made depending on the existence of the mark on the rear surface. However, the kind of a recording sheet may be indicated by means of the number of marks or the length of a mark, and the number or the length may be detected by a sensor.

In each of the embodiments described above, in the case of the second discharge operation for discharging the recording sheet after all the recording is completed, the thermal head is pressed against the drum to overlap the recording sheet and the ink ribbon each other and transport them as shown in FIG. 11, even when no thermal-transfer recording is conducted. Accordingly, in addition to the length of the ink ribbon necessary for actual recording, an additional length of the ink ribbon is required to transport the recording sheet when discharging it.

However, if there is no sufficient length for transporting the recording sheet during the discharge operation in the thermal end of the ink ribbon, and if the end of the ink ribbon is firmly adhered to the supply shaft of the ink ribbon, there is a possibility that discharge operation can not be performed because the ink ribbon comes to its terminal end during the discharge operation and does not advance any more.

Therefore, as the fifth embodiment of the invention, an example which solves the above-described problem will be described with reference to FIGS. 18 and 19.

In this embodiment, in order to solve the above problem, an amount of remaining ink ribbon is detected, and when the detected amount of the remaining ink ribbon is small, the first discharge operation in which the recording sheet is discharged while recording is conducted, is performed irrespective of the current setting of the discharge mode.

Figure 18:
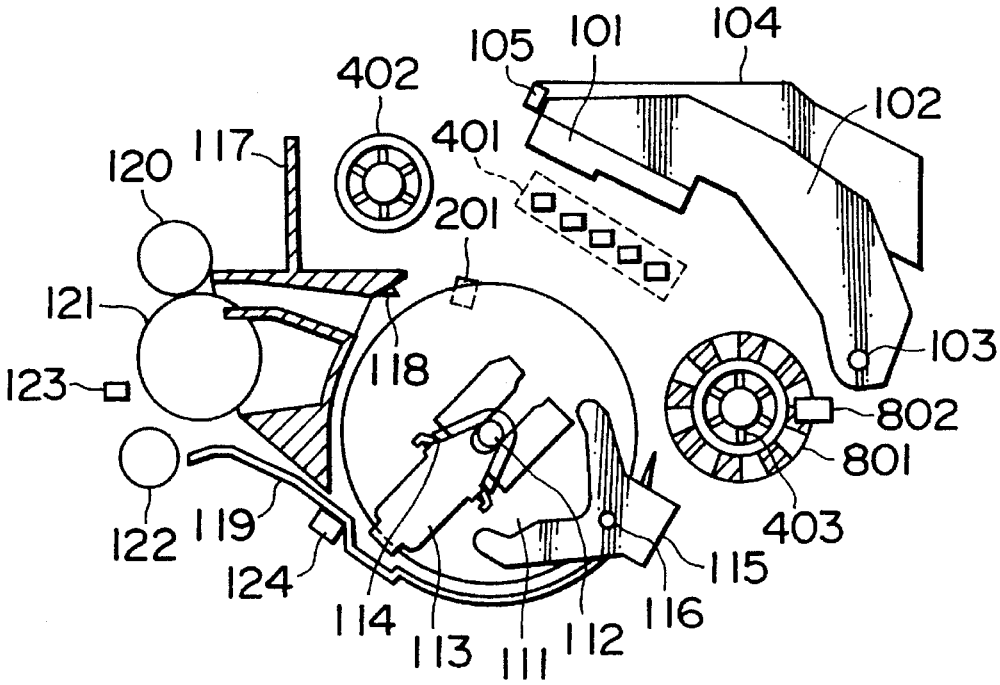
FIG. 18 is a diagram showing the structure of a mechanism unit in a thermal transfer printer as a fifth embodiment of the invention.

FIG. 18 is a diagram showing the structure of a mechanism unit in the thermal transfer printer according to the fifth embodiment of the invention when an ink cassette is not installed thereon. In this figure, reference numeral 801 denotes a reflection plate integrally formed with a reel base 403 on which the supply shaft of an ink ribbon is fitted, and 802 a sensor for detecting the reflection plate. In addition, the same component elements as shown in FIG. 11 or 14 are designated by the same reference numerals.

During recording operation, the ink cassette is installed on the mechanism unit, and the supply shaft of the ink ribbon is fitted on the reel base 403 so that the supply shaft, the reel base 403 and the reflection plate 801 are rotated all together. Accordingly, when the sensor 802 detects the reflection plate 801, it generates pulse signals in accordance with rotation of the reflection plate 801, and therefore, rotation of the supply shaft can be detected.

Figure 19:
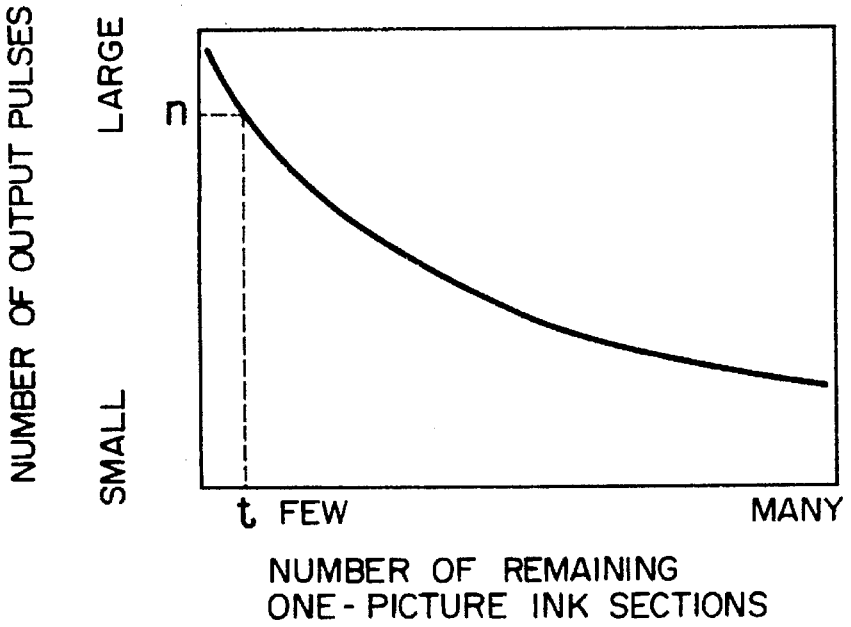
FIG. 19 is a graph illustrative of the relationship between the number of output pulses from a sensor and the number of remaining color sections of the ink ribbon in the thermal transfer printer of FIG. 18.
Figure 20:
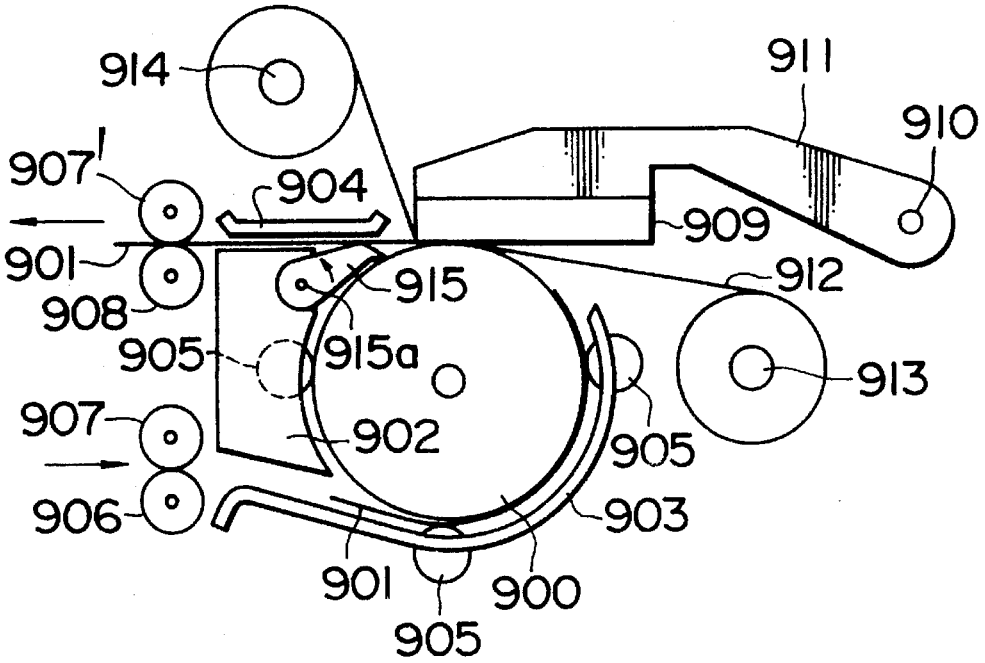
FIG. 20 PRIOR ART
FIG. 20 is a diagram for explaining a recording sheet discharge operation in a conventional thermal transfer printer.

FIG. 19 is a graph illustrative of the relationship between the number of output pulses from the sensor 802 from the moment when positioning of a starting end of yellow ink is performed after starting the recording and feeding the recording sheet, to the moment when positioning of a starting end of cyanine ink is performed just before recording the last color, and the number of one-picture color sections of the remaining ink ribbon in the thermal transfer printer shown in FIG. 18. As the ink ribbon comes near its terminal end, the diameter of the ink ribbon wound on the ink supply shaft decreases. Therefore, even if the ink ribbon of the same length is fed, near the terminal end of the wound ink ribbon where its diameter is small, the rotational speed of the reflection plate is increased, and accordingly, the number of output pulses from the sensor 802 increases.

On the basis of the relationship shown in FIG. 19, the amount of the remaining ink ribbon, i.e., the number of one-picture color sections of the remaining ink ribbon can be known from the number of output pulses from the sensor 802. For example, when the count value of the number of pulses is n, the number of the remaining one-picture ink sections is t.

In this embodiment, the system controller counts the number of output pulses from the sensor 802, and when the count value is n or more, the first discharge operation is performed irrespective of the current setting in the operation unit. In other words, when the number of the remaining one-picture ink sections is t or less, the first discharge operation is automatically performed. Since it is sufficient for the change to the first discharge operation to be determined before recording the last color of cyanine ink is started, the number of pulses may be as well counted until positioning of a starting end of the cyanine ink is performed.

In this embodiment, the first discharge operation is automatically performed when the ink ribbon comes near its terminal end. Accordingly, even if setting for the second discharge operation has been made, it is possible to prevent such a trouble that the ink ribbon has no sufficient length because of its terminal end and the discharge operation can not be carried out. Also, the number of pulses is counted for the length of the ink ribbon from the moment when positioning of a starting end of yellow ink is performed to the moment when positioning of a starting end of cyanine ink is performed just before recording of the third color, and the count length depends upon the pitch between the marks for indicating the starting ends of ink, so that accurate counting can be performed. Further, because counting is performed after recording is started, no trouble occurs even if a partially used ink cassette is installed.

Moreover, in this embodiment, rotation of the supply shaft of the ink ribbon is detected to know the amount of the remaining ink ribbon. However, employed to this end may be a method of detecting the number of one-picture color sections accommodated in an ink cassette by a cassette sensor and counting the accumulative number of recording after the ink cassette is installed. Alternatively, another method may be employed, wherein the diameter of the wound ink ribbon is directly measured by some means in contact or not in contact with the ink ribbon.

According to the invention, when the first discharge operation, since recording and discharge are performed concurrently with each other, the discharge operation is almost completed at the same time when the recording is finished, thereby shortening the recording time. In the case where a color slippage or deviation is liable to occur due to recording sheets, the operation sequence can be changed to the second discharge operation to suppress the color slippage. That is, according to the invention, recording time per sheet can be shortened if necessary, and color deviation can be prevented as situations demand though the recording time can not be shortened much in such cases.

Furthermore, when the amount of the remaining ink ribbon is small, the operation sequence is changed to the first discharge operation in which discharge is conducted during recording. Thus, even if the ink ribbon has no sufficient length because of its terminal end, the discharge operation of recording sheets can be reliably carried out.

What is claimed is:

1. A thermal transfer printer in which a recording sheet is fed from outside through a feeding passage, the recording sheet thus fed is introduced into a transport passage and wound around a platen roller, a thermal head is pressed on the recording sheet and heated to perform recording, and the recording sheet after recording is discharged out of the printer through a discharge passage, the printer comprising:

a selector, including a switch which switches between a first discharge operation and a second discharge operation as a discharge mode of the recording sheet; and a controller which effects control in a manner that when said selector selects the first discharge operation, the recording sheet is introduced to said discharge passage while the recording is carried out, and that when said selector selects the second discharge operation, the recording sheet is introduced to said discharge passage after the recording is completed.

2. A thermal transfer printer in which an ink ribbon having a thin band-like film applied thereon with ink of at least two colors in regular succession, a recording sheet is fed from outside through a feeding passage, the recording sheet thus fed is introduced into a transport passage and wound around a platen roller, the ink ribbon is overlapped on the recording sheet and heated by means of a thermal head to transfer the ink to the recording sheet and perform recording, and the recording sheet after recording of the ink of the two or more colors is discharged out of the printer through a discharge passage branched from the transport passage, the printer comprising:

a selector, including a switch which switches between a plurality of discharge modes, one of discharge concurrent with the recording and a second of separate discharge after the recording in accordance with instructions from the outside; and a controller which effects control in a manner that when said selector selects the discharge concurrent with the recording, the recording sheet is introduced to the discharge passage while recording of the ink of a last color is performed and that when said selector selects the separate discharge after the recording, the recording sheet is introduced to the discharge passage after recording of the ink of the last color is completed.

3. A printer according to claim 2, wherein said selector switches between the discharge modes in accordance with instructions from the outside and a memory for storing a result selected by said selector and said controller comprises a microcomputer which effects control in accordance with the result stored in said memory.

4. A printer according to claim 3, wherein a nonvolatile memory in which erasing and writing can be electrically performed is used as said memory.

5. A printer according to claim 3, further comprising a character display having a screen for displaying items required for selecting the discharge mode on said screen so that instructions can be given from the outside through said switch while watching the items displayed on said screen of said character display.

6. A printer according to claim 5, wherein said character display starts to display the items required for selecting the discharge mode when two or more particular switches are simultaneously operated.

7. A printer according to claim 2, wherein said selector comprises a mechanical switch to select the discharge mode in accordance with instructions from the outside, and said controller comprises a microcomputer which effects control in accordance with a result selected by said selector.

8. A printer according to claim 2, further comprising a discriminator which discriminates between kinds of recording sheet and kinds of ink ribbon, so that discharge operation is selected based on a result of discrimination by said discriminator.

9. A printer according to claim 2, further comprising a detector which detects an amount of the remaining ink ribbon, so that discharge operation is selected based on a result of detection by said detector.

10. A thermal transfer printing process comprising:

introducing a recording sheet into a feeding passage;

winding said recording sheet around a platen roller;

selecting either a first discharge operation or a second discharge operation;

switching between said first discharge operation and said second discharge operation;

pressing a thermal head onto said recording sheet to perform recording; and discharging said recording sheet into a discharge passage wherein said discharging is performed concurrently with said recording when said first discharge operation is selected, and said discharging is performed by releasing said recording sheet from said platen roller after said recording is complete when said second discharge operation is selected.

11. A thermal transfer printing process according to claim 10, wherein said recording comprises:

overlapping an ink ribbon with said recording sheet; and heating said ink ribbon with said thermal head to transfer an ink from said ink ribbon to said recording sheet.

12. A thermal transfer printing process according to claim 11, wherein said ink ribbon comprises a plurality of colors of said ink.

13. A thermal transfer printing process according to claim 11, wherein said selecting is responsive to different kinds of ink ribbons.

14. A thermal transfer printing process according to claim 11, wherein said selecting is responsive to an amount of remaining ink ribbon.

15. A thermal transfer printing process according to claim 10, wherein said selecting is responsive to a switch position.

16. A thermal transfer printing process according to claim 10, wherein said selecting is responsive to information stored in a memory.

17. A thermal transfer printing process according to claim 16, further comprising storing information in said memory by simultaneously operating a plurality of switches.

18. A thermal transfer printing process according to claim 16, further comprising storing information in said memory by selecting items from a character display.

19. A thermal transfer printing process according to claim 10, wherein said selecting is responsive to different kinds of recording sheets.

20. A thermal transfer printer in which a recording sheet is fed from outside through a feeding passage, the recording sheet thus fed is introduced into a transport passage and wound around a platen roller, a thermal head is pressed on the recording sheet and heated to perform recording, and the recording sheet after recording is discharged out of the printer through a discharge passage, the printer comprising:

a selector which selects between a first discharge operation and a second discharge operation of a discharge mode of the recording sheet; and a controller which effects control in a manner that when said selector selects the first discharge operation, the recording sheet is introduced to said discharge passage while the recording is carried out, and that when said selector selects the second discharge operation, said thermal head is lifted from said recording sheet so that the recording sheet is released from the platen roller to be introduced to said discharge passage after recording is completed.

* * * * *